US005256118A

United States Patent [19]

Chen

[11] Patent Number: 5,256,118

[45] Date of Patent: Oct. 26, 1993

[54] PEDAL EXERCISER

[75] Inventor: Ting-Hsing Chen, Tainan, Taiwan

[73] Assignee: Far Great Plastics Ind. Co., Ltd., Tainan Hsien, Taiwan

[21] Appl. No.: 35,264

[22] Filed: Mar. 22, 1993

[51] Int. Cl.[5] ..... A63B 22/04; A63B 21/008

[52] U.S. Cl. ..... 482/53; 482/80; 482/112

[58] Field of Search ..... 482/51-53, 482/111-113, 79, 80

[56] References Cited

U.S. PATENT DOCUMENTS 4,204,675 5/1980 McGinnis ..... 482/80

4,563,001 1/1986 Terauds ..... 482/112

FOREIGN PATENT DOCUMENTS 0154077 9/1985 European Pat. Off. ..... 482/111

*Primary Examiner*—Stephen R. Crow

*Attorney, Agent, or Firm*—Morton J. Rosenberg; David I. Klein

[57] ABSTRACT

A pedal exerciser includes essentially a baseboard, two pedals each having one end connected to the baseboard and the other end supported by two air pumps, a V-shaped linking rod having a bottom portion fastened to a fixture and the other ends detachably secured to the pedals, respectively. A valve is adapted to adjust an upward force towards the pedals, thus the user may adjust the pedals to a desirable exercise resistance.

2 Claims, 10 Drawing Sheets

PEDAL EXERCISER

FIELD OF THE INVENTION

This invention relates to a pedal exerciser. More particularly, a pedal exerciser having an adjusting device to allow proper exercise by all people.

BACKGROUND OF THE PRIOR ART

In today's society, people are getting fat by sitting behind their desks. This will cause many problems to their health. Being aware of such problems, people have started to exercise for a healthy body. They either jog, play balls, or go to gyms to exercise. However, such exercise require either a lot of spare time or a large space to store equipment, despite the money they have to spend to purchase such equipment.

In view of these problems and many others, the inventor has invented the present invention to improve these shortcomings.

SUMMARY OF THE INVENTION

It is the primary object of the present invention to provide a pedal exerciser having pedals adjustable to people of different ages.

It is another object of the present invention to provide a pedal exerciser which is safe during exercise.

It is a further object of the present invention to provide a pedal exerciser which is easy to operate.

It is still a further object of the present invention to provide a pedal exerciser which takes less space to store.

DETAILED DESCRIPTION OF THE PREFERRED EMBODIMENT

Figure 1:
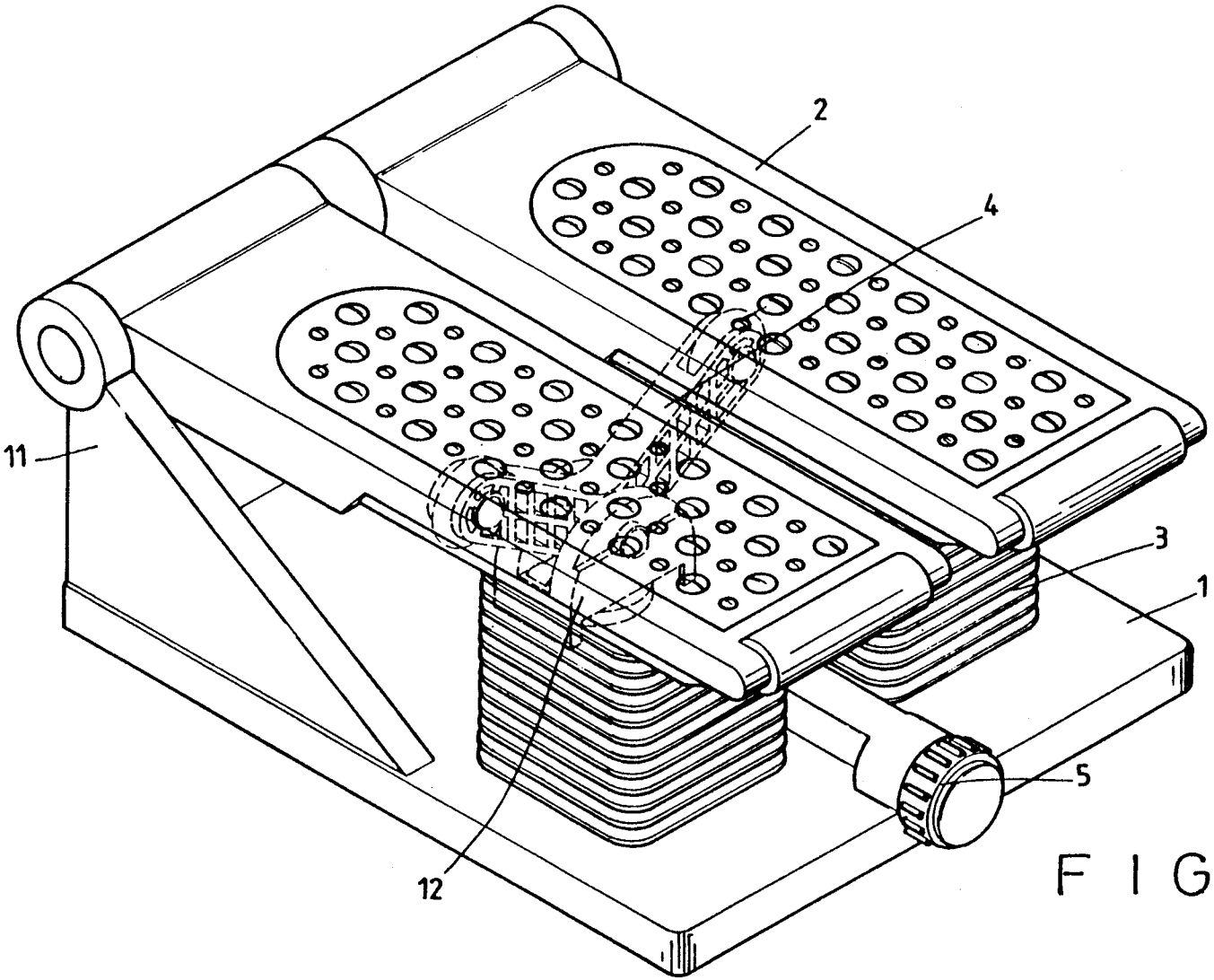
FIG. 1 is a perspective view of the present invention.

Reference is now made to FIG. 1 of the present invention which comprises a baseboard means 1, two pedals 2, each one end connected to the baseboard 1, two bellows 3 connected to the bottom portions of the pedals 2 and the baseboard 1, respectively, a linking means 4, and an air pressure means 5.

Figure 2:
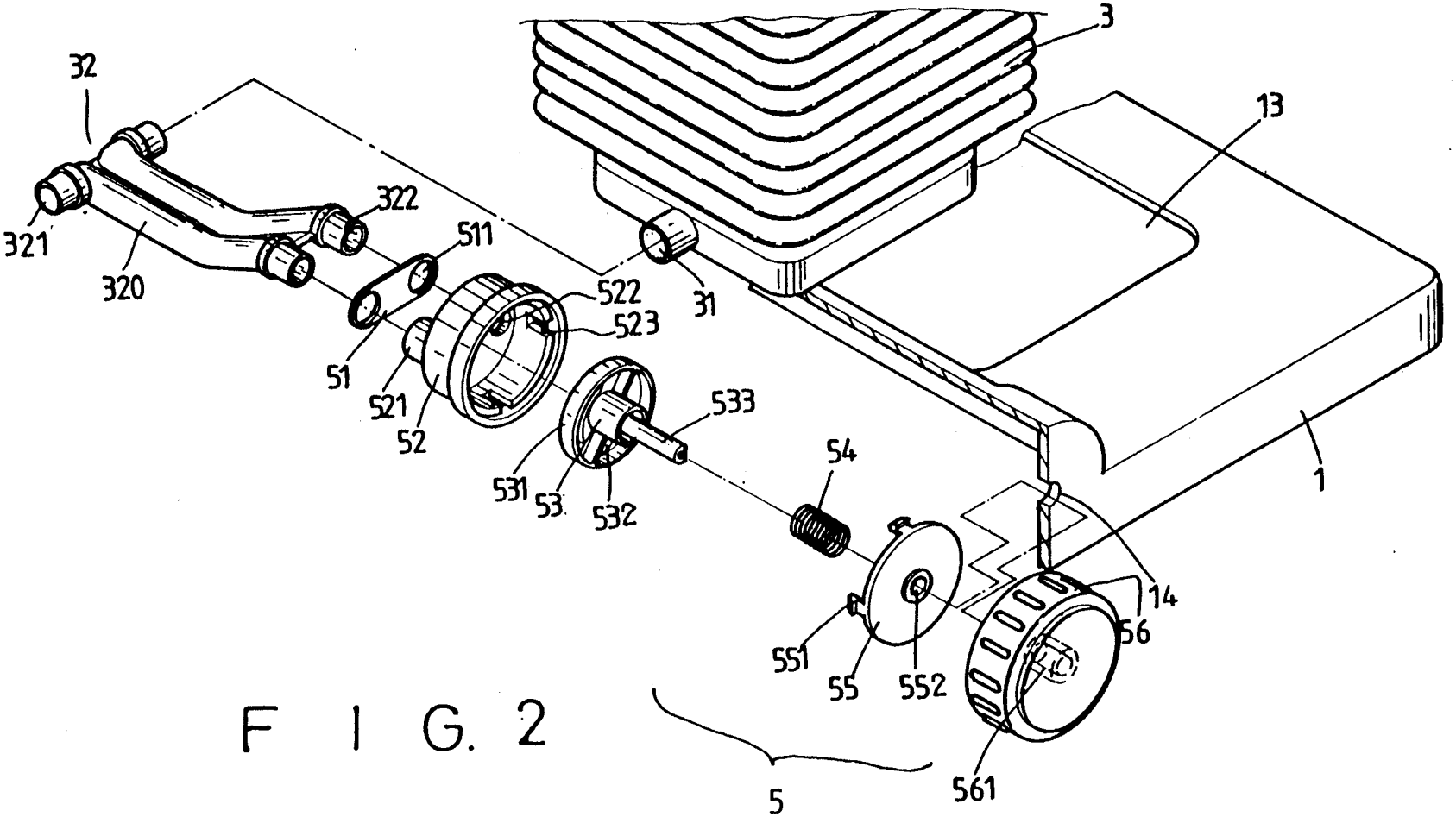
FIG. 2 is a breakdown of air pressure means of FIG. 1.
Figure 3:
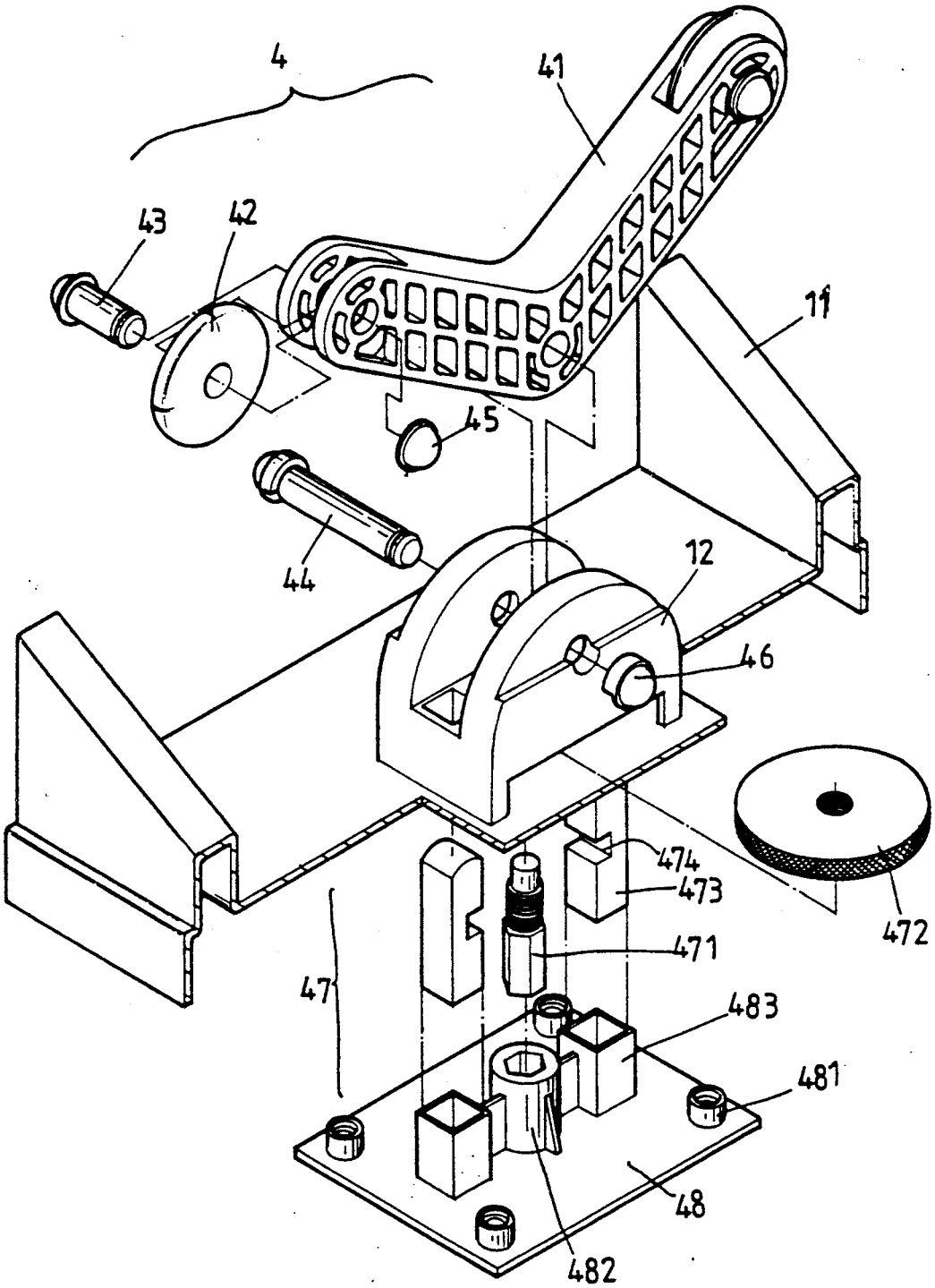
FIG. 3 is a breakdown of a linking means of FIG. 1.
Figure 4:
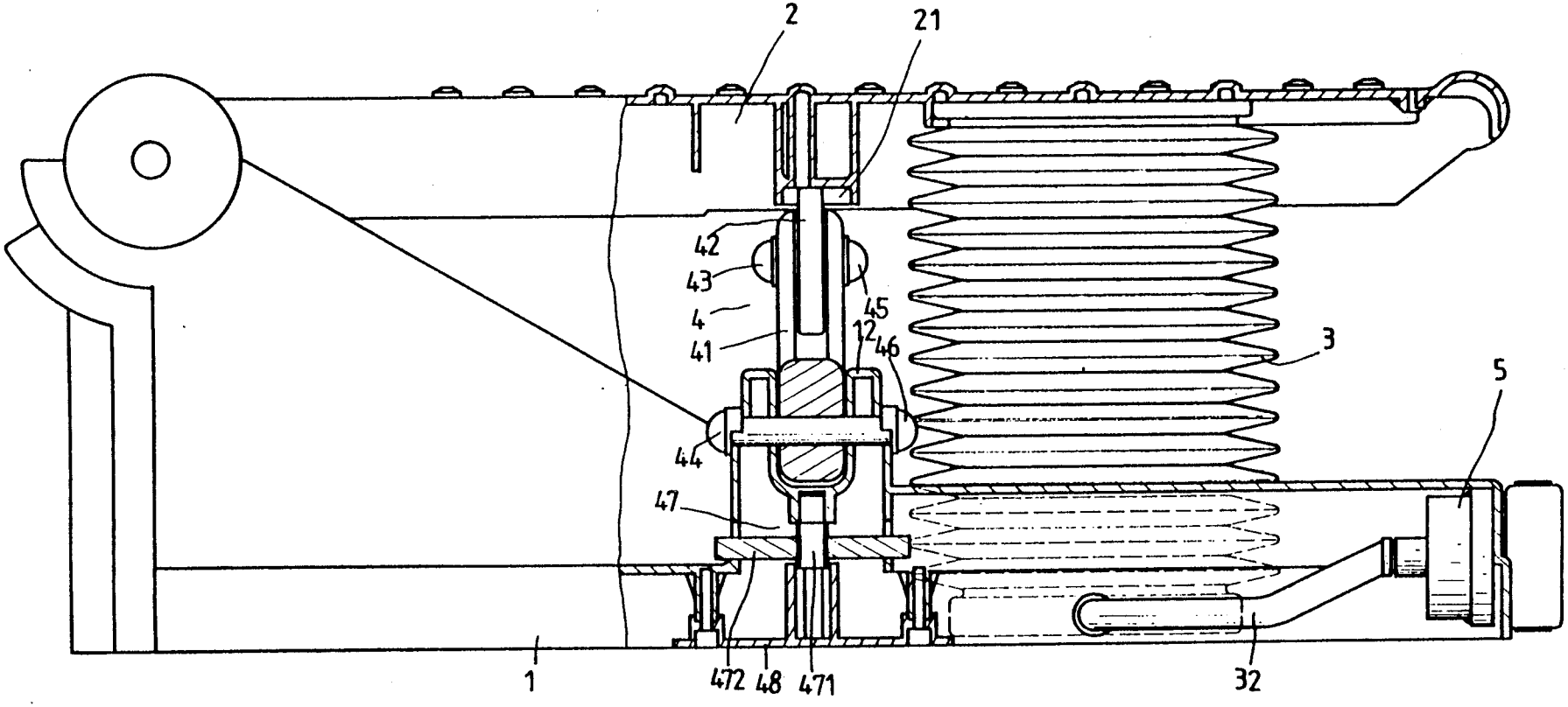
FIG. 4 is a side sectional view of FIG. 1.
Figure 5:
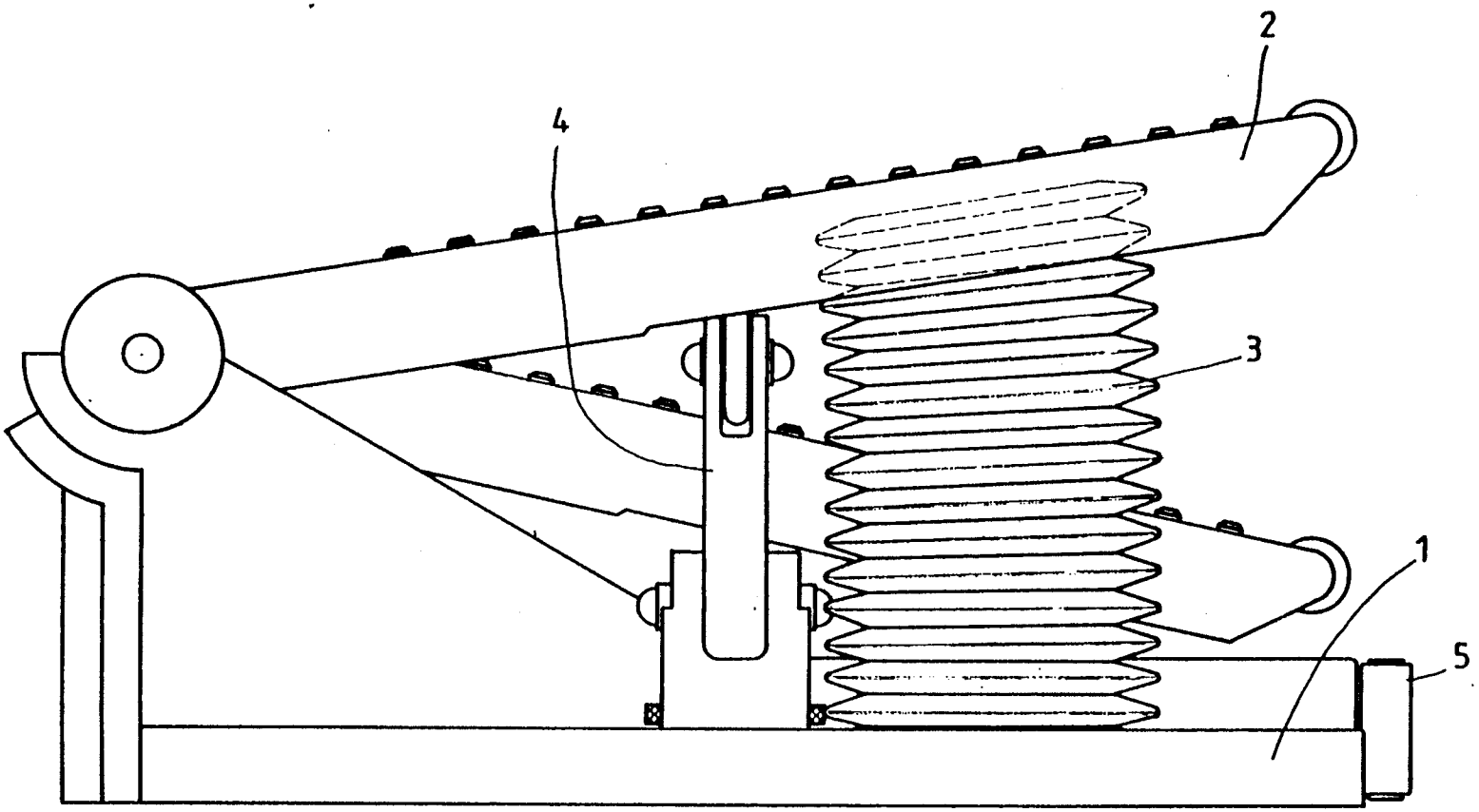
FIG. 5 is a side elevational view of FIG. 1, in operation.
Figure 6:
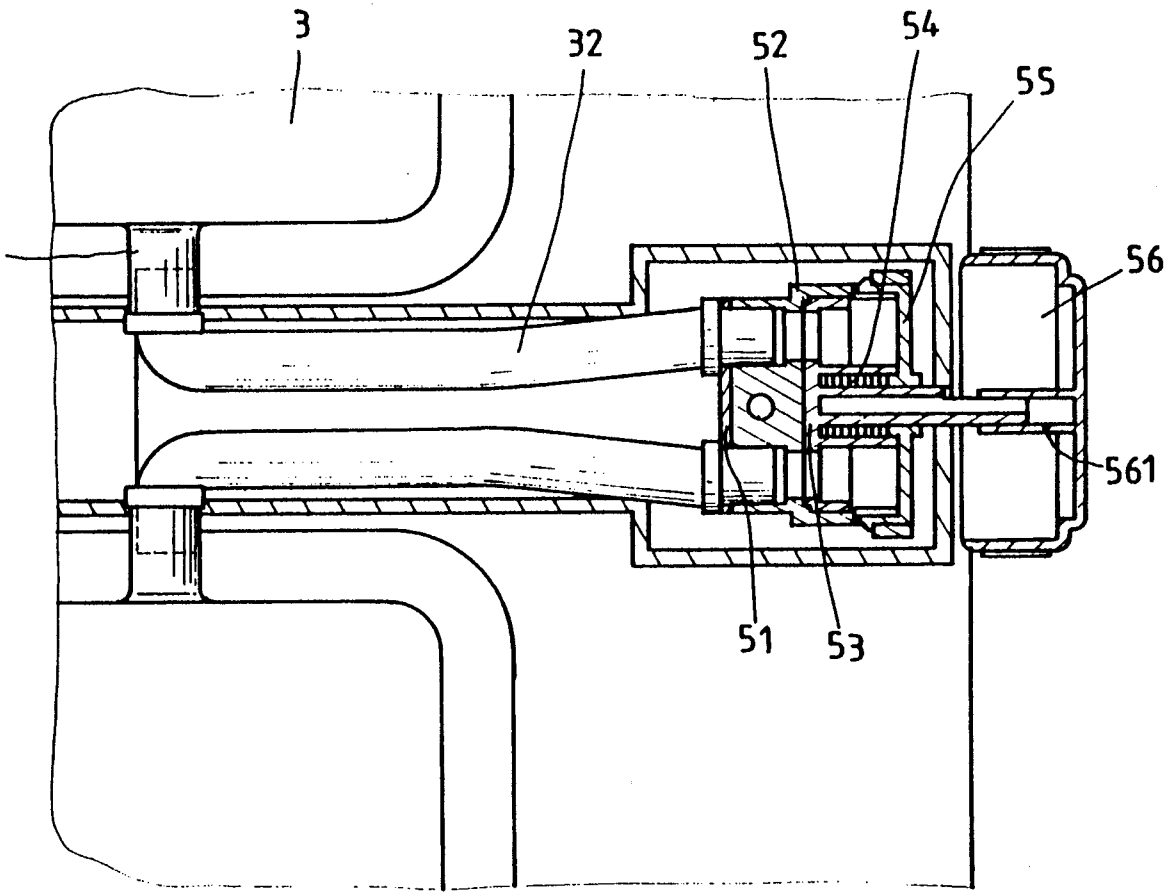
FIG. 6 is a top sectional view of a baseboard of FIG. 1.
Figure 7:
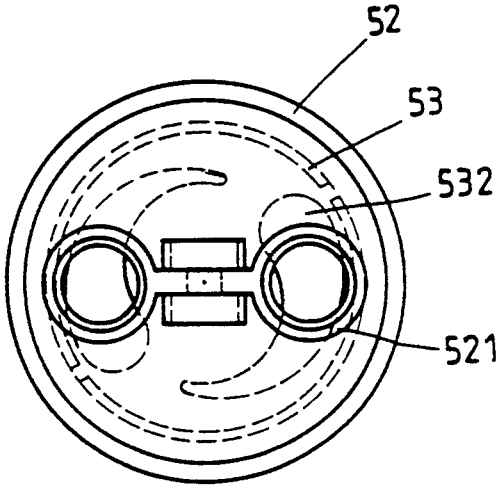
FIG. 7 is a front sectional view of a valve of the pressure means of FIG. 2.
Figure 8:
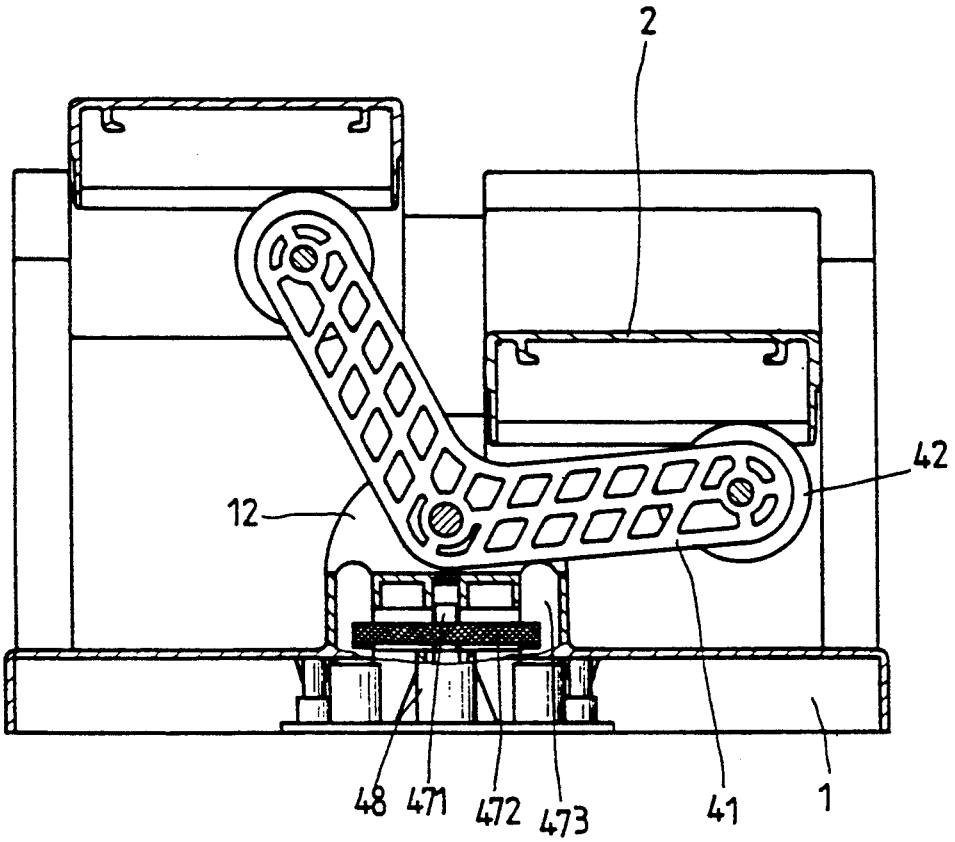
FIG. 8 is a rear sectional view of FIG.
Figure 9:
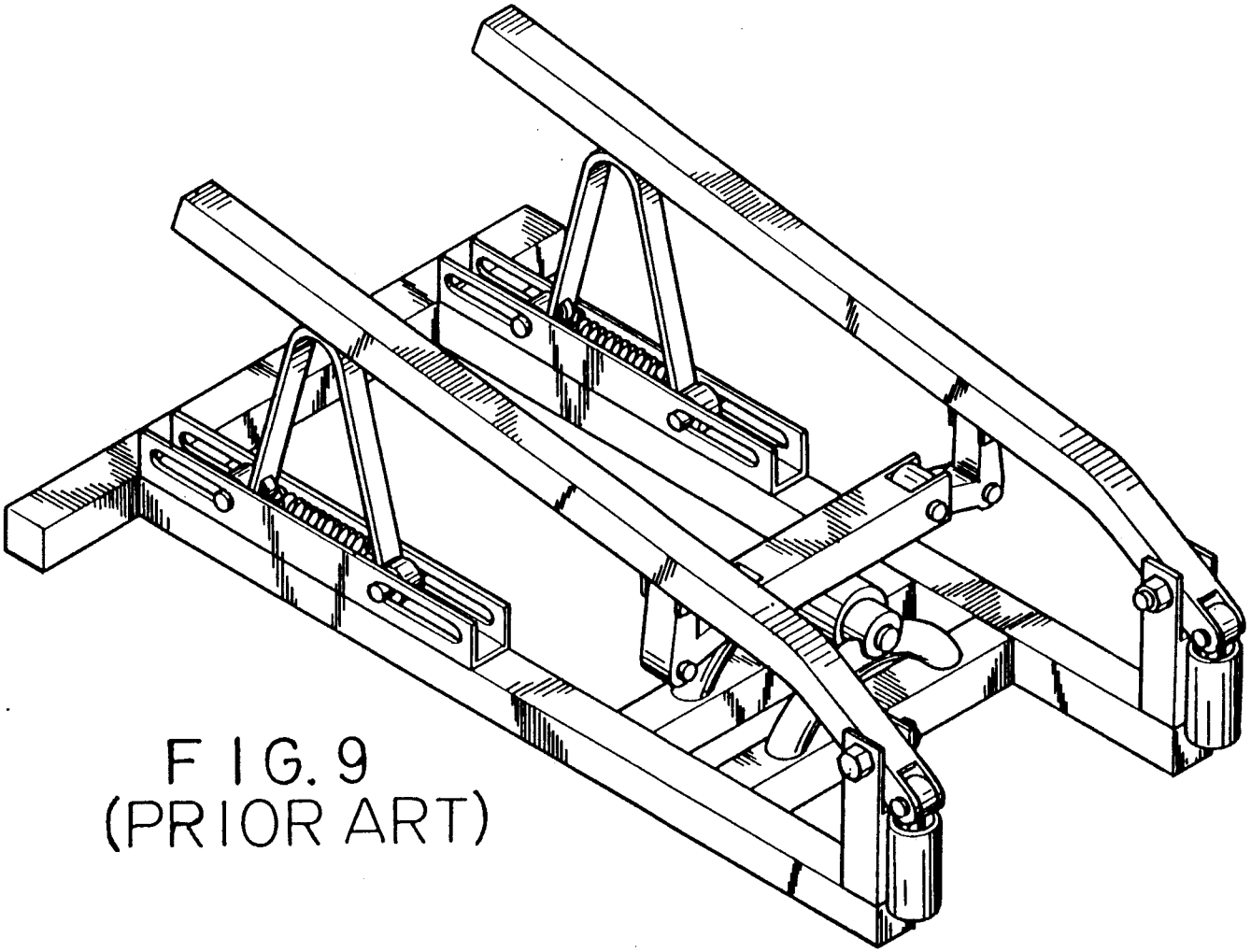
FIG. 9 (PRIOR ART)
FIGS. 9 and 10 are prior arts devices.
Figure 10:
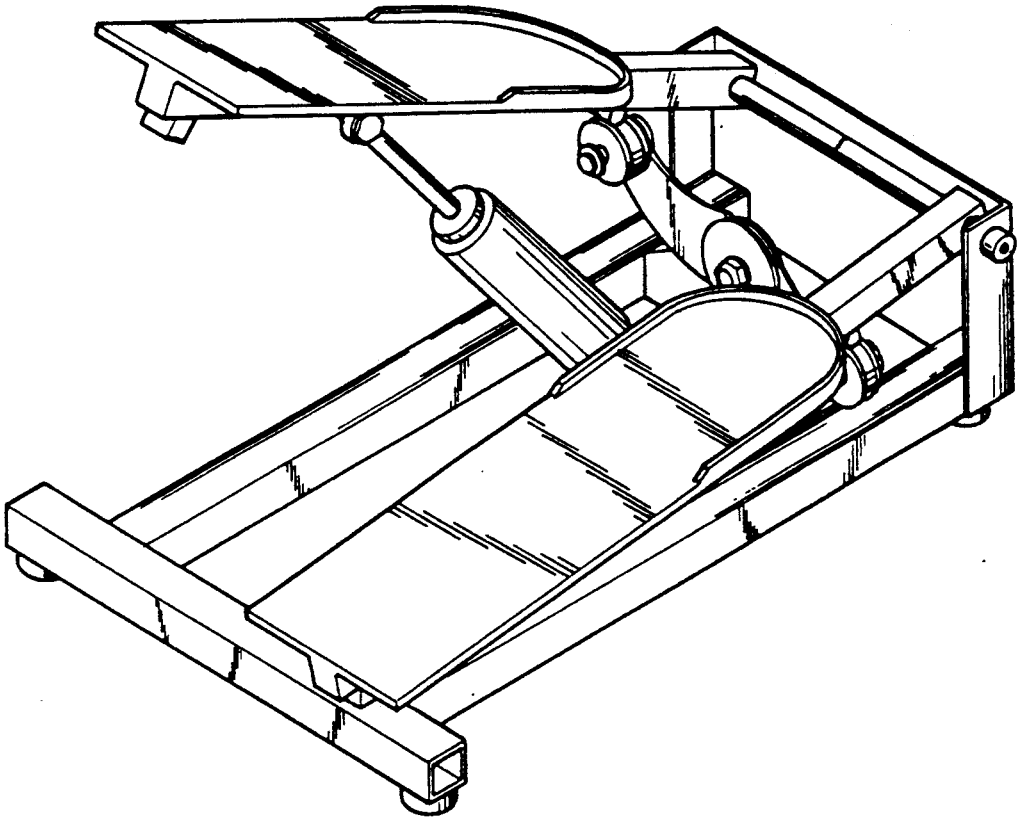
FIG.10 (PRIOR ART)

The baseboard means 1, according to FIG. 3, longitudinal in shape, has a pair of walls 11 extending upwardly from one end of respective sides thereof adopted to secure the pedals 2, each of which has a bellow 3 connected a bottom portion, a mounting 12 at a top center portion adapted to hold the linking means 4 thereat, an inlet 14 at one end thereof adapted to receive the air pressure 5. The bellows 3, according to FIG. 2, each are essentially comprised of a hole 31 at a portion, and a double T fitting 32 located in the inlet 14 having its top opening ends 321 connected to each hole 31. The other ends 322 of the T fitting 32 are connected to the air pressure means 5.

The linking means 4 has a V-shaped linking rod 41 swivably connected at its bottom portion to the mounting 12 by means of bolt 44 and nut 46. A pair of pulleys 42 are rotatably connected to respective top ends by means of bolts 43 and nuts 45. The pulleys 42 are slidably located in the two rails 21 of the two pedals 2, respectively. A regulating device 47 located underneath the linking means 4 includes a base frame 48 having three receiving posts 482, 483 extending upwardly therefrom. Two receiving posts 483 at respective outer ends have square holes at inner portions adapted to receive a pair of identical blocks 473 therein, while the middle post 482 has hexagon hole at an inner portion adapted to receive a peg 471 therein. Each of the blocks 473 has a slot 474 at the middle portion. A disc 472 has a hole at center adapted to be inserted into the peg 471 while the peripheral edges of the disc 472 are inserted into the slots 474 of the blocks 473, respectively. The topmost portions of the two blocks 473 are in touch with the bottom portions of the respective pedals 2. This arrangement allows the user to exercise like a normal walk, that is when user steps his right foot down, the linking rod 41 will also swivel to its right whereas the block 473 at right hand side goes down and the other block 473 goes up, simultaneously. Vise versa, when the user's left foot steps down, linking rod 41 turns to its right which brings the left peg 473 down and the right peg 473 up.

The air pressure means 5 is mainly located within the inlet 14 of the baseboard 1 and consists of a washer 51 attached to a socket 52. The socket 52 includes a pair of apertures 521 adapted for the insertion of the longer ends 322 of the T fitting 32 therethrough, an air passage 522 therein, and a plurality of holes 523. A valve seat 53, seated in the socket, has a spindle 531 extending from one end therefrom and through a spring 54, an aperture 552 of a cap 55 and into an aperture 561 of a knob 56. The cap 55 has a plurality of clips 551 adapted to insert into holes 523 coinciding therewith in pattern.

In operation, turning the knob 56 adjusts the air pressure means 5 to the desirable measurement which allows the user to step the pedals 2 down in a comfortable manner. That is, when the user steps pedal 2 down, the bellows 3 shall provide a certain amount of resistant force which requires the user to step the pedal 2 harder. In addition to the air pressure means 5, the linking rod 41 of the linking means 4 also functions as an auxiliary support to the user.

I claim:

1. A pedal exerciser comprising:

a baseboard having two walls extending upwardly from one end of respective sides, a mounting on the top portion of said baseboard, an air inlet at the inner middle portion therein;

two pedals each having one end connected to said walls, respectively, and two rails located on the bottom surfaces of each pedals;

two bellows having one end of each connected to the bottom portions of said pedals, respectively, the other ends of said blasts being connected to said baseboard.

a linking means having a V-shaped linking rod swivably secured at its bottom to said mounting of said baseboard, and a regulating device secured to the bottom portion of said mounting; two pulleys rotatably secured to respective top ends of said linking rod and located within said respective rails of said pedals;

an air pressure means having a pressurized air container washer, a socket having two holes at one end adapted to receive a T fitting, a valve seat having a spindle extending from one end through a cap into a knob whereby said value seat is adjusted to vary the exercise resistance during pedal movement.

2. A pedal exerciser of claim 1, wherein said regulating device is essentially comprised of a base frame having three receiving posts extending upward from one side in parallel arrangement having the outmost two receiving posts receive two blocks while the middle receiving post is adapted to receive a peg; and a disc is threaded onto said peg with its peripheral edges inserted into a slot of each in said blocks.

* * * * *